United States Patent [19]

Yokokawa

[11] Patent Number: 4,805,503

[45] Date of Patent: Feb. 21, 1989

[54] LOAF SLICING MACHINE

[75] Inventor: Toshiyuki Yokokawa, Tokyo, Japan

[73] Assignee: Omori Machinery Co., Ltd., Japan

[21] Appl. No.: 98,011

[22] Filed: Sep. 17, 1987

[30] Foreign Application Priority Data

| | | | |
|---|---|---|---|
| Sep. 17, 1986 | [JP] | Japan | 61-141445[U] |
| Sep. 25, 1986 | [JP] | Japan | 61-145862[U] |
| Nov. 7, 1986 | [JP] | Japan | 61-170282[U] |

[51] Int. Cl.[4] ..... B26D 1/18; B26D 7/06

[52] U.S. Cl. ..... 83/355; 83/409.2; 83/412; 83/422; 83/444; 83/465; 83/467 R; 83/592

[58] Field of Search ..... 83/356, 355, 409.2, 83/412, 415, 420, 422, 465, 467 R, 444, 676, 446, 592

[56] References Cited

U.S. PATENT DOCUMENTS

| | | | |
|---|---|---|---|
| 3,161,215 | 12/1964 | Werder et al. | 83/731 |
| 3,842,698 | 10/1974 | Fitch et al. | 83/91 |
| 3,880,035 | 4/1975 | Divan | 83/422 |
| 4,428,263 | 1/1984 | Lindee et al. | 83/355 |
| 4,685,364 | 8/1987 | Scheflow et al. | 83/355 |

FOREIGN PATENT DOCUMENTS

| | | | |
|---|---|---|---|
| 2147405 | 5/1973 | Fed. Rep. of Germany | 83/355 |
| 59-193695 | 6/1983 | Japan . | |

*Primary Examiner*—Frank T. Yost
*Assistant Examiner*—Hien H. Phan
*Attorney, Agent, or Firm*—Emrich & Dithmar

[57] ABSTRACT

A loaf slicing machine includes a cutting blade arranged to rotate about a center axis thereof while moving around an orbital axis to thereby cut the loaf cyclically, a feed member for intermittently advancing the loaf toward the cutting blade and extending perpendicularly to the cutting blade, and a guide member disposed between the feed member and a path of the cutting blade for guiding the loaf. In order to hold the loaf, an abutment plate is provided which has a surface spaced from the edge of the cutting blade toward a direction of advance of the loaf for permitting the end of the loaf to abut on that surface during each cutting cycle and of which rotational center is aligned with the orbital axis, the abutment plate being arranged to rotate sychronously with the cutting blade. An opening is formed through the abutment plate at a position adjacent the cutting blade for permitting slices as cut to be transferred through the opening.

17 Claims, 11 Drawing Sheets

LOAF SLICING MACHINE

BACKGROUND OF THE INVENTION

1. Field of the Invention

The present invention relates to a loaf slicing machine of the kind in which a loaf of ham, bacon and the like is advanced at a constant rate to a cutting blade which cuts the loaf into slices of desired thickness 2. Description of the Prior Art A typical slicing machine of the above kind includes a pair of spaced rotary belts between which a loaf of about 1 to 2 meters long is advanced intermittently into an orifice formed in a guide member. A distance of the rotary belts is usually adjustable so that loaves having different sizes may be fed. A cutting blade is disposed at a position slightly forward of an exit of the orifice to cyclically slice the end of the loaf, a thickness of the slices being determined by an advanced distance of the loaf in each cycle. The guide member is intended to prevent a displacement of the end portion of the loaf due to a force which is exerted by the blade when it cuts the loaf, and the orifice is typically formed to have a size substantially equal to the size of the loaf. The slices are transferred onto a conveyor which fowards the slices to a packaging machine. A stacker may be arranged between the blade and the conveyor for accumulating the slices as cut to form stacks thereof and for supplying the stacks to the conveyor.

One example of the above slicing machine is disclosed in Japanese Utility Model Laid-Open document No. 59-193695. A cutting blade disclosed therein is adapted to rotate about its center axis which is rotatably secured to a support body. The suport body itself revolves around an orbital axis positioned away from the center axis of the blade toward the periphery thereof. The combination of the two rotational movements is such that the blade edge cuts the loaf into a slice during one rotaion of the support body around the orbital axis. A pair of rotary belts advance the loaf a distance per each cycle and during the blade edge is away from the cutting place.

The loaf is held between the rotary belts which terminates just before the guide member. The loaf becomes shorter as the cutting proceeds. When the rear end of the loaf is disengaged from the rotary belts, the belts can no longer advance the loaf. It is thus necessary to supply the loaves continuously so that the forward, disengaged loaf can be advanced by the end-to-end contact with the succeeding loaf. As mentioned above, the blade which rotates at a high speed urges the loaf toward the direction of movement of the blade when cutting, and it becomes difficult to resist such a force by the guide member as the length of loaf decreases and after the rotary belts release the loaf. Thus, the blade tends to pull the loaf out of the guide member, resulting in an irregularity in thickness and/or shape of the slices. Those irregular slices are not available as a part of the products, which means that the rear end portion of the loaf is wasted. Further, the irregularly cut slices often scatter away from the blade onto various portions of the machine and regular slices on the conveyor. To remove the scattered slices is a troublesome work.

It is therefore an object of the present invention to provide a loaf slicing machine which can cut a loaf into slices of desired thickness through an entire length of the loaf to thereby avoid a waste of a material.

Another object of the invention is to provide a loaf slicing machine which may prevent a scatter of the slices, which would otherwise reduce a production efficiency.

SUMMARY OF THE INVENTION

According to the invention, a loaf slicing machine includes a cutting blade adapted to rotate about a center axis thereof while moving around an orbital axis to thereby cut the loaf cyclically. Feed means for intermittently advancing the loaf toward the cutting blade extends substantially perpendicularly to the cutting blade, and a guide member is disposed between the feed means and a path of the cutting blade for guiding the loaf. Also provided is an abutment plate having a surface spaced from the edge of the cutting blade toward a direction of advance of the loaf for permitting the end of the loaf to substantially abut on the surface during each cutting cycle. The abutment plate has a rotational center aligned with the orbital axis and is adapted to rotate synchronously with the cutting blade. An opening is formed through the abutment plate at a position adjacent the cutting blade for permitting slices as cut to be transferred through the opening.

As a cutting operation proceeds, the loaf becomes shorter and is released from the feed means. That loaf is thereafter advanced by a next loaf. The abutment plate prevents an excessive advance of that loaf and prevents the cutting blade from pulling that loaf out of the guide member which, in turn, maintains that loaf in a correct direction. Therefore, the entire portion of the loaf can be cut into slices of a substantially uniform thickness, thereby avoiding a waste. Further, the abutment plate cooperates with the opening to prevent a scatter of slices, resulting in an improved production efficiency.

Other objects, features and advantages of the invention will be apparent from the following detailed description thereof when taken in conjunction with the accompanying drawings.

DETAILED DESCRIPTION OF THE INVENTION

Figure 1:
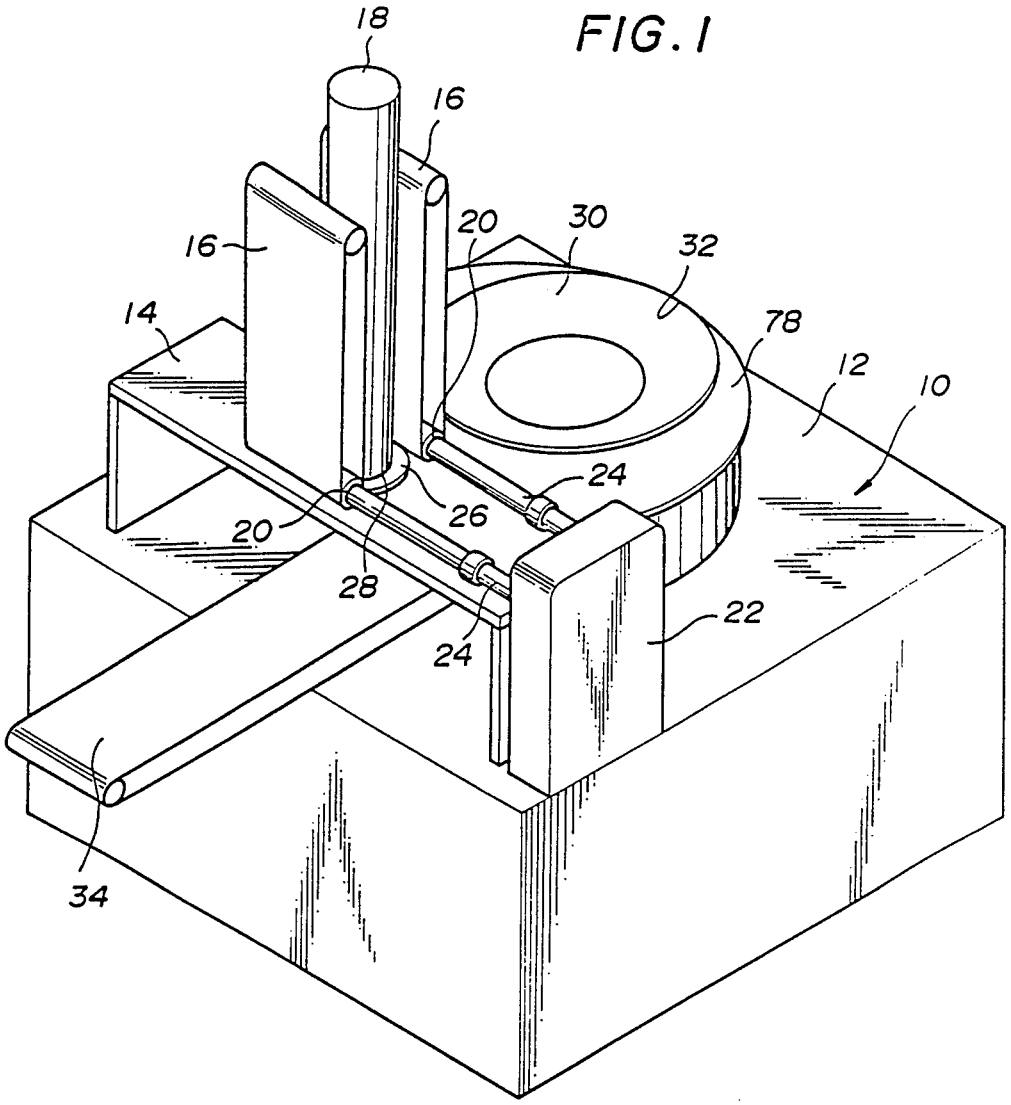
FIG. 1 is a perspective view showing schematically a loaf slicing machine according to an embodiment of the present invention.

Referring first to FIG. 1, a loaf slicing machine according to an embodiment of the invention includes a box-like housing 10 which has a support 14 in the form of a gate and secured to a front portion of the upper surface 12 of the housing. Disposed on the support 14 are a pair of upright rotary belts 16 which are spaced from each other to feed a loaf 18 therebetween and which include at the lower ends respective drive pulleys 20 connected to a drive device 22 through shafts 24. The drive device 22 is attached on the upper surface 12 adjacent the support 14 and connected to a known power transmission mechanism (not shown) within the housing 10 for rotaring the shafts 24 and therefore the pulleys 20 intermittently. During each rotational movement of the pulleys 20, the rotary belts 16 advance the loaf 18 a distance which is determined to correspond to a desired thickness of a slice to be cut. The upper surface of the support 14 is formed centrally thereof with an opening 15 (see FIG. 3) through which the loaf 18 is permitted to advance downwardly. A ring-shaped guide member 26 is fitted in the opening 15 and has an orifice 28 of a diameter substantially equal to the diameter of the loaf 18 to prevent a dispacement of the end portion of the loaf 18 in the horizontal direction.

Figure 2:
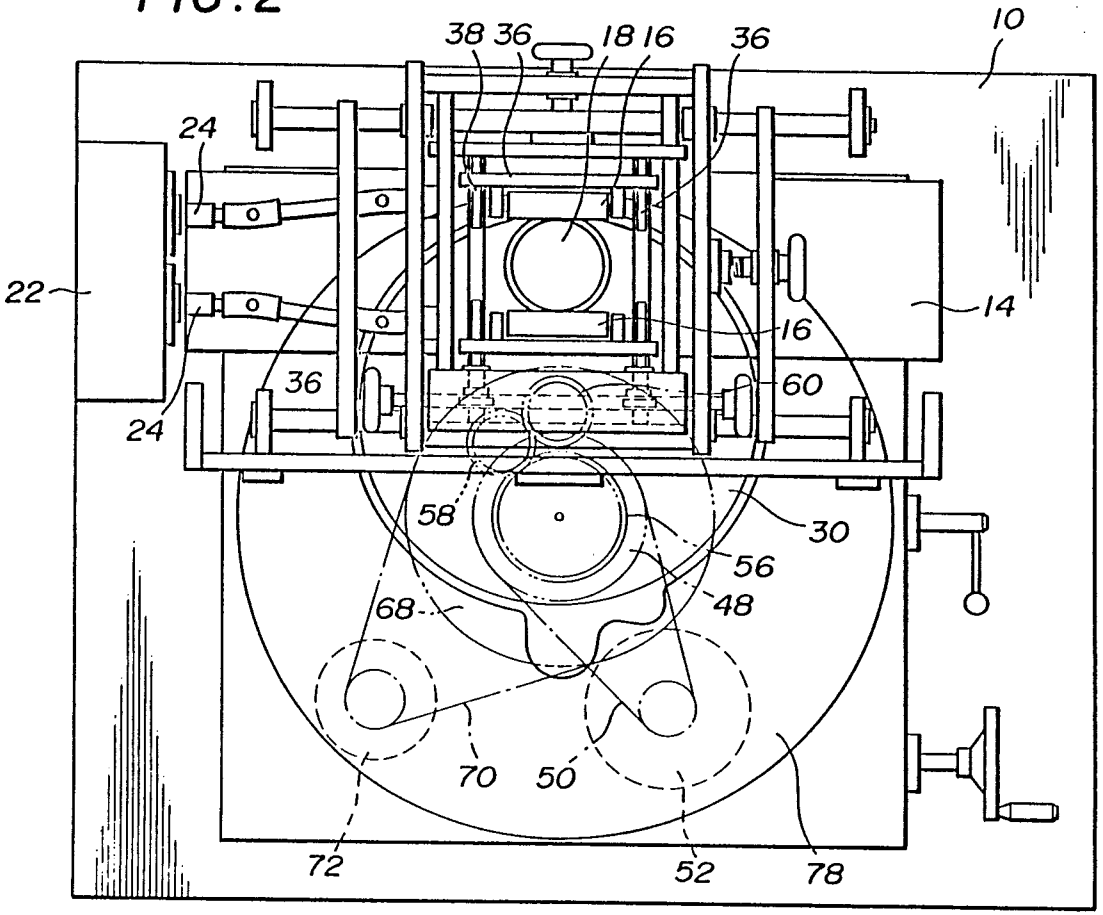
FIG. 2 is a plan view thereof.

A cutting blade 30 is mounted on the housing 10 for cyclically slicing the end portion of the loaf 18 projected from the guide member 26. The blade 30 is a little inclined upwardly from its center so that a blade edge 32 is positioned at a level slightly below the lower end of the guide member 26. A conveyor 34 is disposed below the guide member 26 to feed slices as cut to a subsequent process such as packaging. Stacking means (not shown) may be provided between the blade 30 and the conveyor for accumulating a predetermined number of slices as a stack and transfer the stack to the conveyor 34. As shown in FIG. 2, the two rotary belts 16 are arranged parallel to each other and secured to respective support boards 36 which are coupled to each other by a pair of screw joints 38. A distance between the support boards 36 and, therefore, between the belts 16 is adjustable by the screw joints 38 so that loaves having different sizes can be fed.

Figure 3:
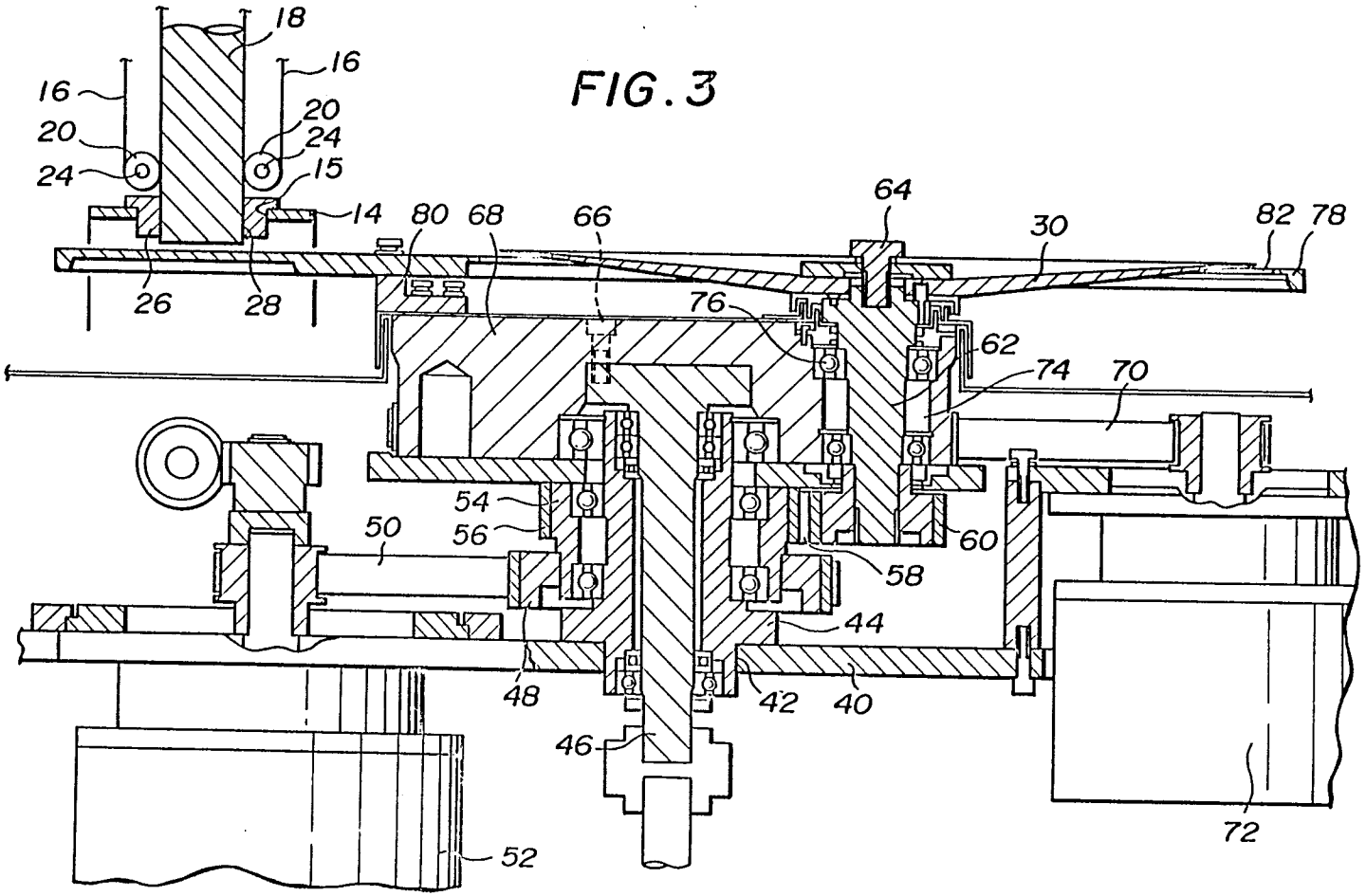
FIG. 3 is fragmentary sectional view thereof in an enlarged scale.

With reference to FIGS. 2 and 3, a base plate 40 fixedly secured to the housing 10 has an aperture 42 in which the lower end of a hollow, substantially cylindrical flange 44 is tightly fitted. A main shaft 46 extends through the flange 44 for rotation relative thereto. Arranged around the lower portion of the flange 44 is a ring member 48 adapted to turn about the flange 44 by a first timing belt 50 which is driven by a first motor 52 mounted on the base plate 40. A tubular connector 54 is fixed to the inner surface of the ring member 48 and has at the upper portion thereof a first annular gear 56 engaging with an idle gear 58 which, in turn, engages with a second annular gear 60. This annular gear 60 is fixed to the lower end of an axis 62, and the blade 30 is secured to the upper end of the axis 62 by a bolt 64. Accordingly, when the timing belt 50 is driven by the motor 52, the rotational movement of the ring member 48 is transmitted through the gears 56, 58 and 60 to the axis 62 for rotating the blade 30 thereabout.

Attached to the upper end of the main shaft 46 by means of a stud 66 is a rotary body 68 which has a diameter considerably larger than the diameter of the ring member 48. A second timing belt 70 extends between the rotary body 68 and a second motor 72 mounted on the base plate 40 to rotate the body 68 about the main shaft 46. The rotary body is formed, at a peripheral portion thereof away from the main shaft 46, with a bore 74 in which the blade axis 62 is rotatably secured via bearings 76. Thus, the rotation of the body 68 causes the axis 62 and the blade 30 to orbit around the main shaft 46, so that the blade 30, while rotating about its axis 62, cyclically moves into the cutting place below the guide member 26. The number of revolution of the blade 30 during each orbital movement is variable to enable the blade 30 to smoothly cut the loaf 18 of various kinds. The above arrangements for rotating and orbiting the blade 30 are substantially the same as those disclosed in the Japanese Utility Model Laid-Open No. 59-193695 discussed above.

An abutment plate 78 in the form of a disk is concentrically mounted on the rotary body 68 for co-rotation therewith through an attachment 80 fixed to the upper peripheral portion of the body 68. The abutment disk 78 has a diameter much larger than the diameter of the body 68, such that the disk 78 extends beyond the blade edge 32 and that the peripheral portion thereof is positioned below the guide member 26. The upper surface of the disk 78 is arranged to space from the blade edge 32 a distance substantially equal to or slightly larger than a desired thickness of the slices to be cut. In order to permit an adjustment of such a distance, at least one of the disk 78 and the blade 30 is preferably movable in the vertical direction. A circular opening 82 is formed in the disk 78 for accommodating the blade 30. The opening 82 has a dimension substantially equal to or slightly larger than the blade 30 so that the slices as cut by the blade 30 can fall through the opening 82, as described below.

In operation the loaf 18 is intermittently advanced by the rotary belts 16 with each advance being carried out while during the blade 30 is out of the cutting place, and is cut into slices by the blade 30. As the cutting operation proceeds the length of the loaf 18 decreases. After the rotary belts 16 releases the rear end of the short loaf, it is further advanced by a next loaf through an end-to-end contact and is retained by the guide member 26. At this time, even if the retaining force of the guide member 2 is insufficient, the front end of surface of the loaf 18 abuts against the upper surface of the disk 78 and slides relative thereto so that further advance of the loaf 18 due to a gravity is prevented. The guide member 26 then restricts a displacement of the loaf only in the horizontal direction. The disk 78 also prevents the blade 30 from pulling out the loaf 18 downwardly and in the direction of movement of the blade, though a resistance between the loaf and the blade tends to slightly compress the end portion of the loaf against the disk 78.

Accordingly, the loaf 18, even after released from the rotary belts, is mantained in position at each cycle with extending perpendicularly to the blade 30, thereby enabling the blade to cut the loaf accurately. The slices thus cut are urged in the direction of movement of the blade 30 and fall through the opening 82 which moves together with the blade.

In the illustrated embodiment, the orbital movement of the blade 30 and the rotation of the abutment plate 78 are effected by the common member, i.e. the rotary body 68. Various other structures, however, may be possible for synchronizing the movements of the blade and the abutment plate. Also, the abutment plate is not limited to the disk shape, and the opening may extend to the peripheral edge of the plate at the side of the blade. Further, the invention is also applicable to a slicing machine of the type in which a blade extends in the vertical direction and a loaf is fed along the horizontal direction.

Figure 4:
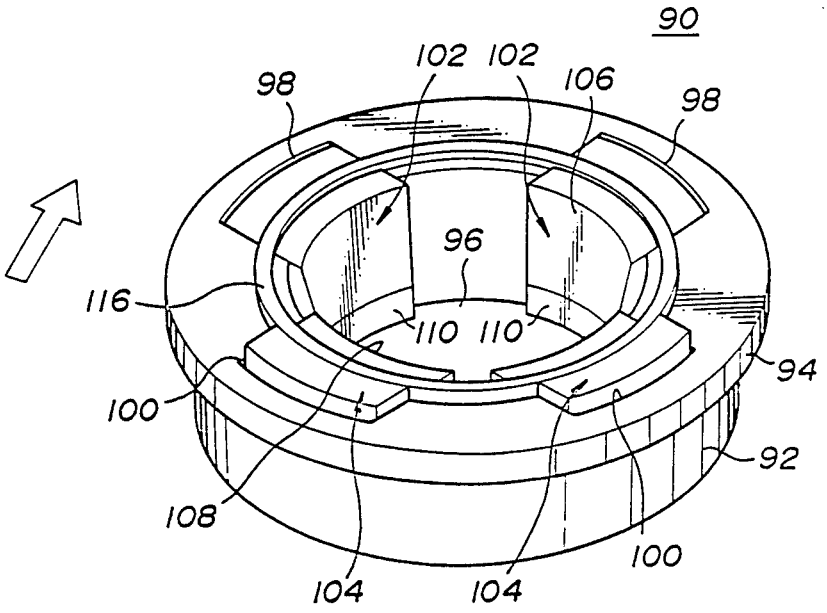
FIG. 4 is a perspective view showing an example of a guide member in the loaf slicing machine.

FIG. 4 illustrates a preferred form of a guide member to be fitted in the opening 15 of the support 14. This guide member 90 includes a tubular body 92 having an orifice 94 through which cyindrical loaves are advanced, and an upper flange 96 for attachment to the support. Formed in the inner surface of the body 92 defining the orifice 94 are four recesses arranged at angular intervals of 90 degrees. These recesses are divided into two pairs, i.e. the first recesses 98—98 which are disposed in the fore side of the movement of blade 30 as indicated by an arrow in the drawing, and the second recesses 100—100 disposed in the rear side of the blade movement. In other words, the guide member 90 is attached to the support 14 in such a manner that the blade 30 moves into the cutting place from the second recesses 100 and towards the first recesses 98. Each of the recesses extends throughout the vertical length of the orifice 96 and has an upper portion having a radial length greater than that of a lower portion, as seen from FIG. 5.

Figure 5:
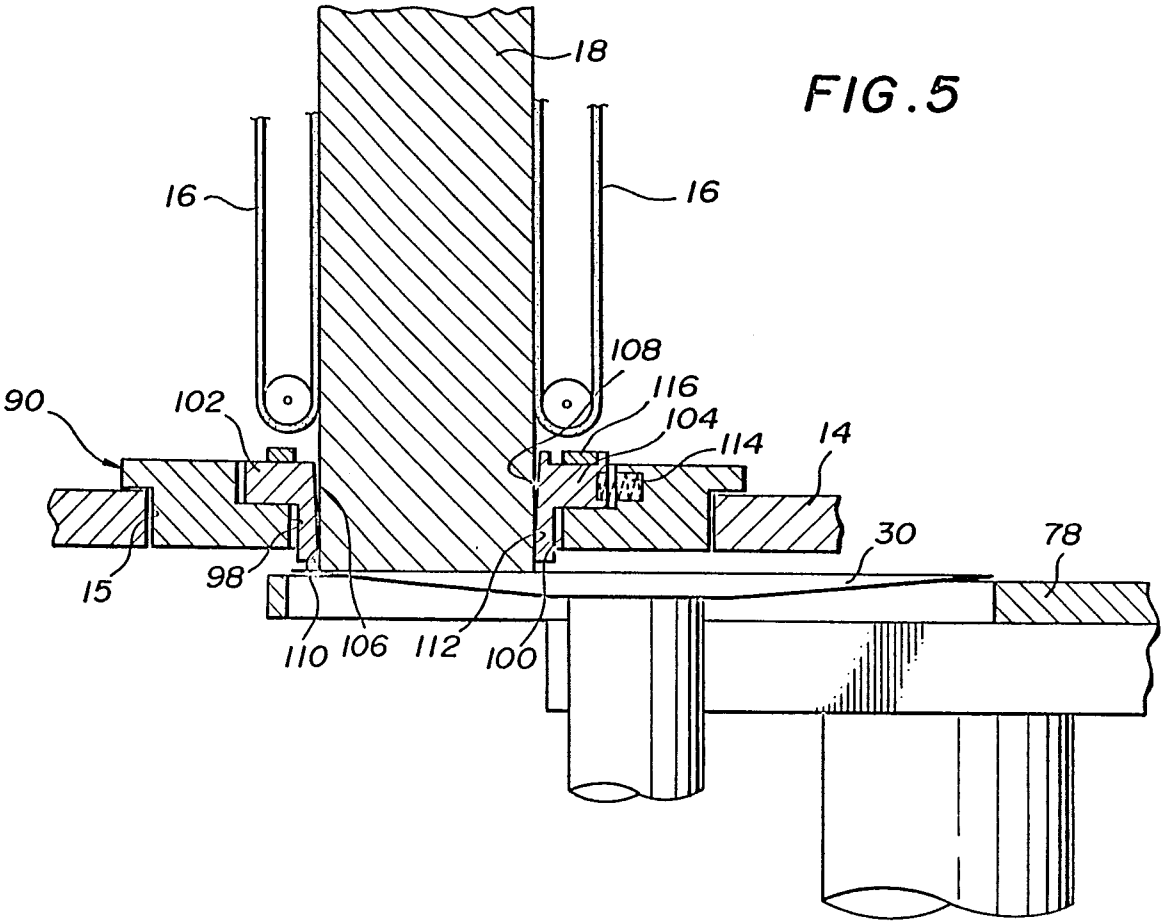
FIG. 5 is fragmentary a sectional view showing the guide member of FIG. 4 as incorporated in the loaf slicing machine.

First jaws 102 are fixedly secured in the first recesses 98 with partly projecting into the orifice 96, while second jaws 104 are received in the second recesses 100 movably along the radial direction and also partly projects into the orifice 96. As shown in FIG. 5, each of these jaws has an inverted L-shape to fit in the recess with the vertical portion being arranged inside. The inner surfaces 106 and 108 of the first jaw 102 and second jaw 104, respectively, are somewhat inclined inwardly toward the lower portions thereof and terminate with lower end portions 110 and 112 which extend substantially parallel to the axis of orifice 96. At least the lower end portions 110, 112 of the inner surfaces 106, 108 are arcuate in order to permit a surface contact with the loaf 18. In the illustrated embodiment, the entire portions of the inner surfaces 106, 108 are arcuate. Suitable urge means such as a spring 114 is provided between the outer end of each second jaw 104 and the outer surface of each second recess 100 to normally urge the second jaw 104 radially inwardly, i.e. toward the axis of orifice 96. A retaining ring 116 is attached to the upper surface of the guide member 90 and prevents the jaws 102, 104 from being disengaged from the recesses 98, 100. If desired, the first jaws 102 may be formed integrally with the body 92.

When the loaf 18 is advanced by the rotary belts 16, the lower end portion of the loaf enters into the orifice 96 with the inclined inner surfaces 106, 108 of the jaws 102, 104 serving as guides. Further advance causes the loaf 18 to penetrate through the orifice 96 and to reach a level of the blade 30. At this time, since the second jaws 104 urge the loaf in the radial direction toward the first jaws 102 through an elastic force of the spring 114, the loaf 18 is prevented from displacing in the horizontal direction and is supplied to the blade 30 at a proper position while mantained perpendicularly thereto. To increase the elastic force of the spring 114 for positively guiding the loaf 18 will not damage the outer surface portion of the loaf, because the surface contact between the arcuate inner surfaces 110, 112 prevents the jaws 102, 104 from digging into the loaf.

At the moment the slicing is carried out, the blade 30 tends to press the loaf 18 in the direction of blade movement. However, the first jaws 102 which are stationarily disposed in the fore side prevents the end portion of loaf 18 from displacing forwardly and maintains its normal position. This involves a slight compression of the loaf 18 due to the pressure of the blade 30. As a result, the second jaws 104 projects radially inward by the spring 114 to follow the loaf 18. Also, the second jaws 104 retracts outwardly as the loaf 18 recovers its normal dimension immediately after the blade moves out of the cutting place. Thus, the loaf 18 can be guided accurately throughout the slicing operation. Apparently, the second jaws 104 cooperates with the springs 114 also to permit a dimensional error of the loaf 18 which might occur during manufacture thereof.

Figure 6:
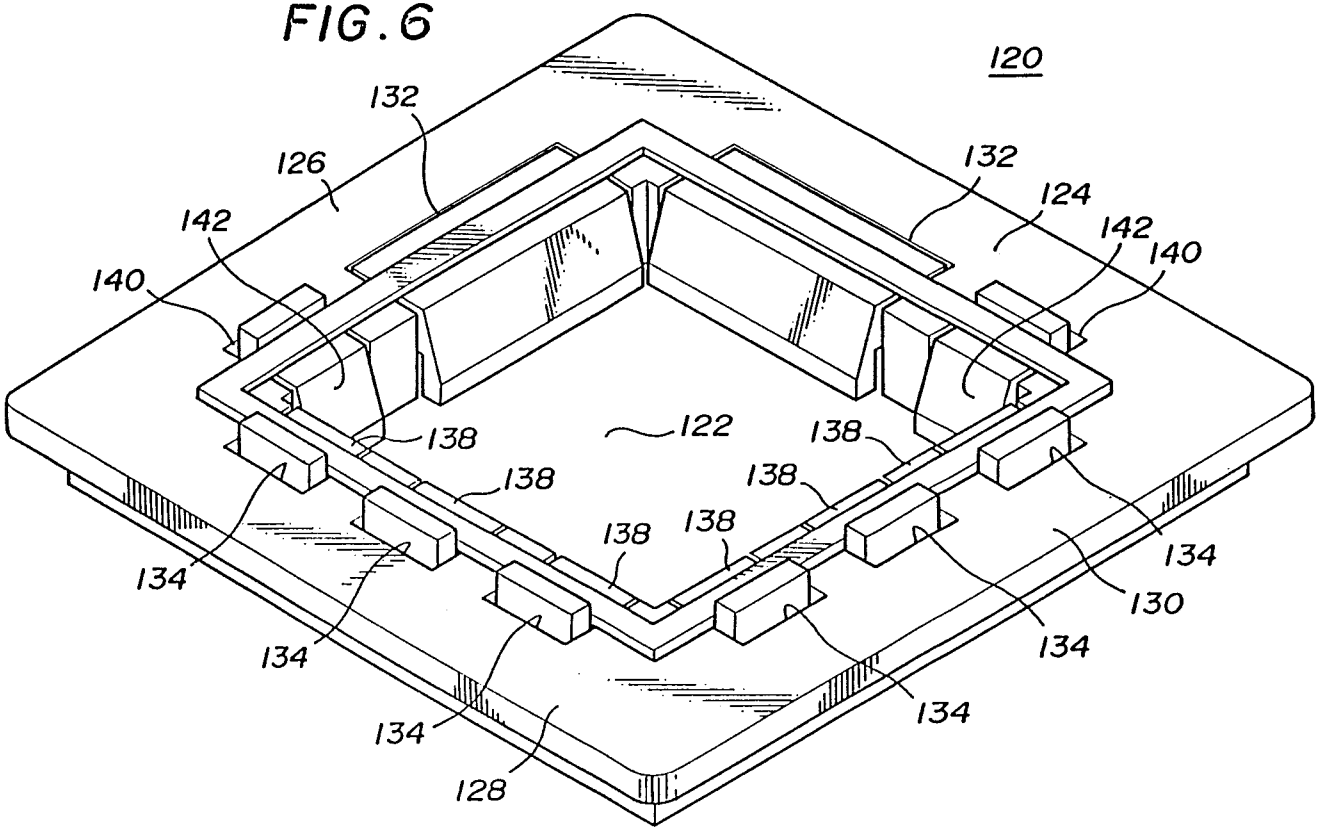
FIG. 6 is a perspective view showing another example of a guide member.

A guide member 120 illustrated in FIG. 6 is used for guiding a loaf having a square cross section. Thus, the guide member 120 has a square shape in plane and its square orifice 122 is defined by four sides 124 to 130 on which to arrange first jaws 136 recesses and second jaws 138. The blade moves into the cutting place from a corner defined by the sides 128 and 130 and out thereof from a corner between the sides 124 and 126. The first jaws 136 are fixedly secured in first recesses 132 formed in the sides 124 and 126, while the second jaws 138 are movably received in second recesses 134 formed in the sides 128 and 130 together with spring means as in the above example. The inner surfaces of these jaws 136, 138 are substantially flat in the sense that they are not arcuate, so that each lower end portion thereof makes surface contact with each side of the loaf. Each of the movable jaws 138 comprises three separate pieces having the same shape, each piece being movable independently from other pieces. Third jaw 142 are movably received in third recesses 140 formed on the sides 124 and 126 at positions adjacent the sides 130 and 128, respectively, and are urged radially inward by spring means. These third jaws 142 are not stationary because the pressure exerted by the blade is directed toward the corner between the sides 124 and 126. Other structures and operations of the guide member 120 are generally the same as in the above guide member 90.

Figure 7:
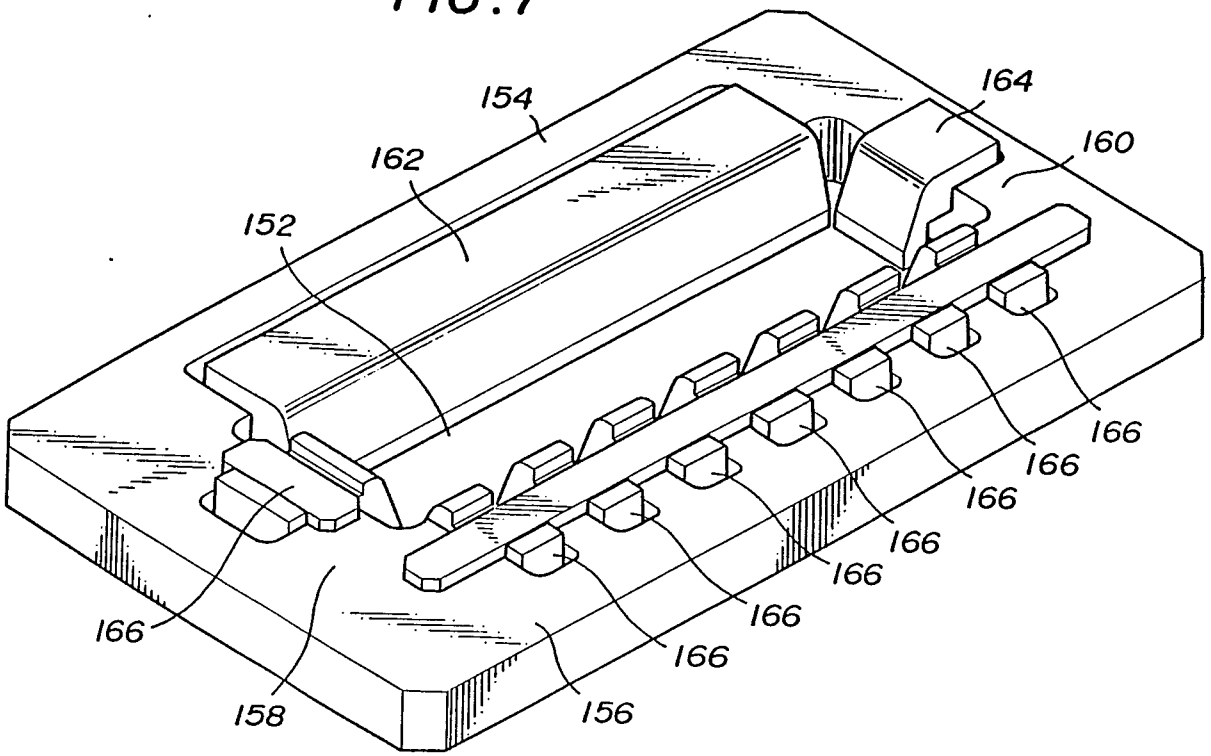
FIG. 7 is a perspective view showing still another example of a guide member.
Figure 8:
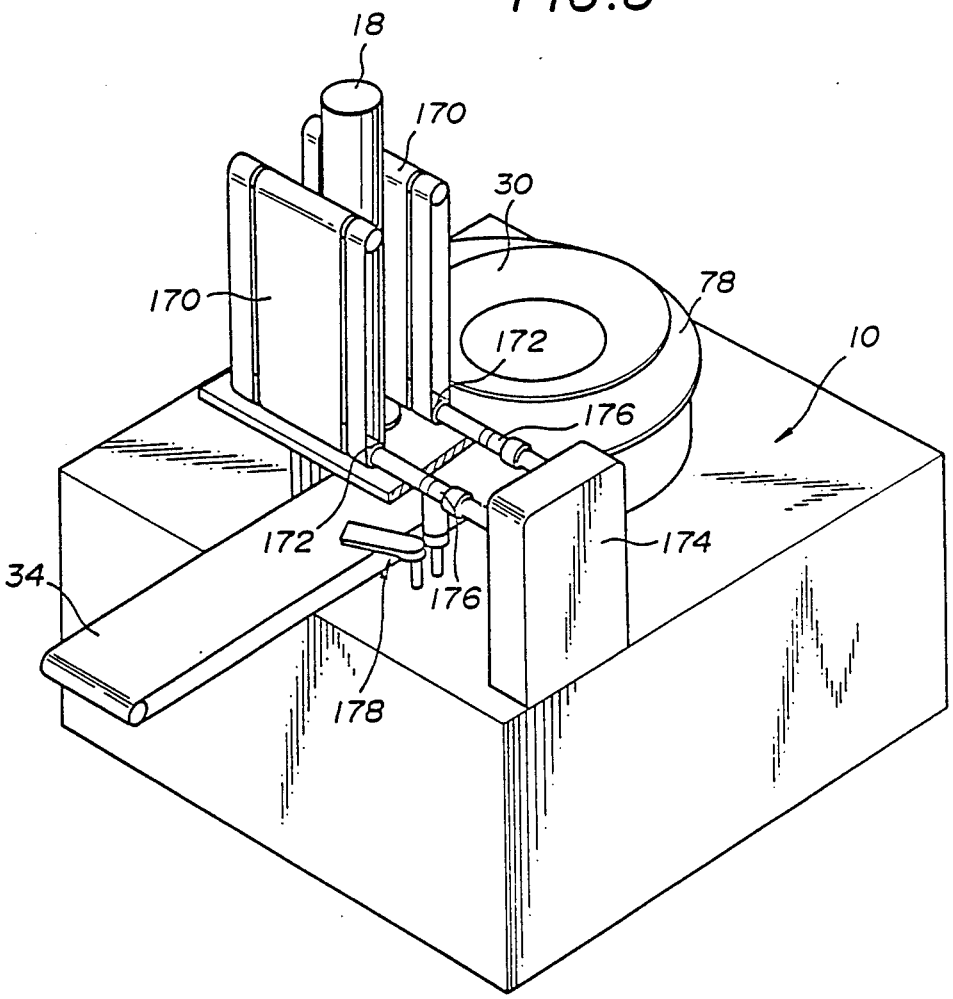
FIG. 8 is a perspective view showing a general structure of a loaf slicing machine according to another embodiment of the invention.

FIG. 7 illustrates still another example of a guide member for use in a loaf having a rectangular cross section and to be incorporated in a slicing machine of the type in which the blade 30 extends in the vertical direction to cut the loaf advanced along the horizontal direction. An orifice 152 of this guide member 150 is rectangular in plane and is defined by the longer sides 154, 156 and the shorter sides 158 and 160, the sides 154 constituting the lower end of the orifice 152 when the guide member 150 is attached to a support. The blade cuts the loaf from the side 156 to the side 154. First jaws comprising a longer jaw 162 and a shorter jaw 164 are fixedly secured to the sides 154 and 158, respectively. One of movable second jaws 166 is disposed on the side 160 and faces the shorter first jaw 164, while the other second jaws are arranged along the side 156 to face the longer first jaw 162.

Referring next to FIGS. 8 to 11 of the drawings, preferred structures of a loaf feeding mechanism are illustrated in detail. The mechanism includes a pair of rotary belts 170—170 between which the loaf 18 is advanced, each rotary belt comprising three strips arranged in side by side relationship. The rotary belts 170 are driven by pulleys 172 connected to a drive device 174 through shafts 176. The drive device 174 is in turn connected to a power transmission device (not shown) within the housing 10 for rotating the shafts 176 intermittently, as described above. A stacker 178 is illustrated as arranged between the blade 30 and the conveyor 34 to accumulate slices as cut. As seen from FIG. 9, each shaft 176 has universal joints 180 that permit the shaft 176 to swing in the horizontal plane. Movably mounted on the housing 10 is a frame 182 opened at the upper and lower ends thereof and having a rectangular shape in plan view to surround the rotary belts 170 and their support boards 184. A first handle 186 is secured to the front wall 188 of the frame 182 and extends reawardly for threaded engagement with one of the support boards 184, so that the rotary belt 170 attached to that support board may be moved toward and away from the front wall 188 by rotating the handle 186. A pneumatic cylinder 190 is mounted to the rear wall 192 of the frame 182 and is connected to the other support board 184 for moving the other rotary belts 170 toward and away from the rear wall 192. By these arrangements, a distance between the rotary belts 170 is adjustable to thereby allow the loaves of different sizes to be fed to the blade 30.

Four posts 194 extend inwardly from the housing 10 at positions outside the frame 182 and adjacent the respective corners of the frame. These posts 194 are divided into two pairs each for supporting therebetween a rod 196 extending parallel to the front and rear walls 188 and 192 of the frame 182. A pair of guide plates 198—198 are mounted on each rod 196 slidably therealong. The frame 182 is movably secured at the corners thereof to the inner surfaces of the respective guide plates 198. Thus, the rotary belts 170 will be moved in the direction perpendicular to their surfaces 171 by the movement of the frame 182 along the guide plates 198, and in the direction parallel to the surfaces 171 by the sliding movements of the guide plates 198 on the rods 196.

Figure 9:
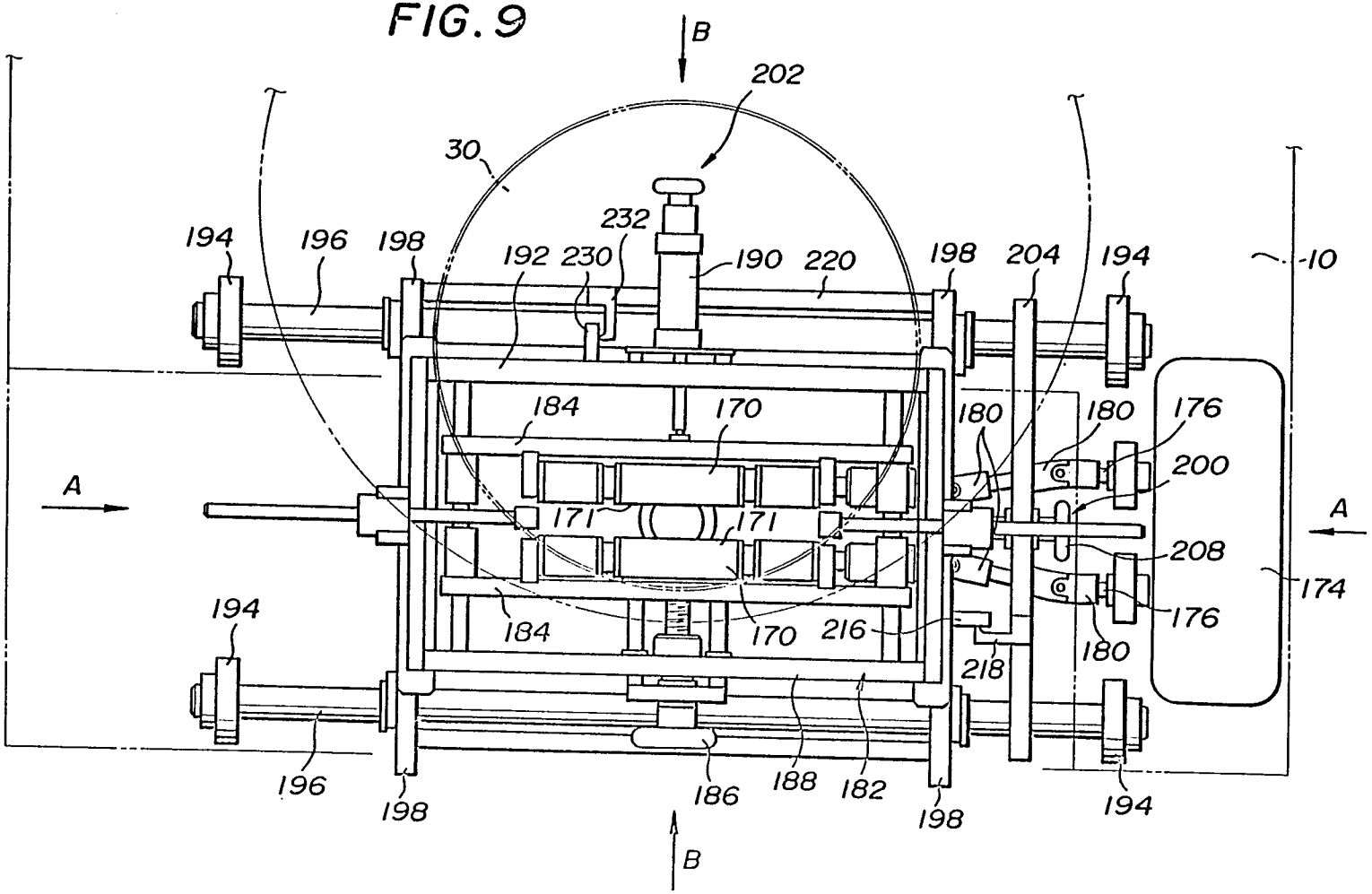
FIG. 9 is an enlarged plan view thereof.
Figure 10:
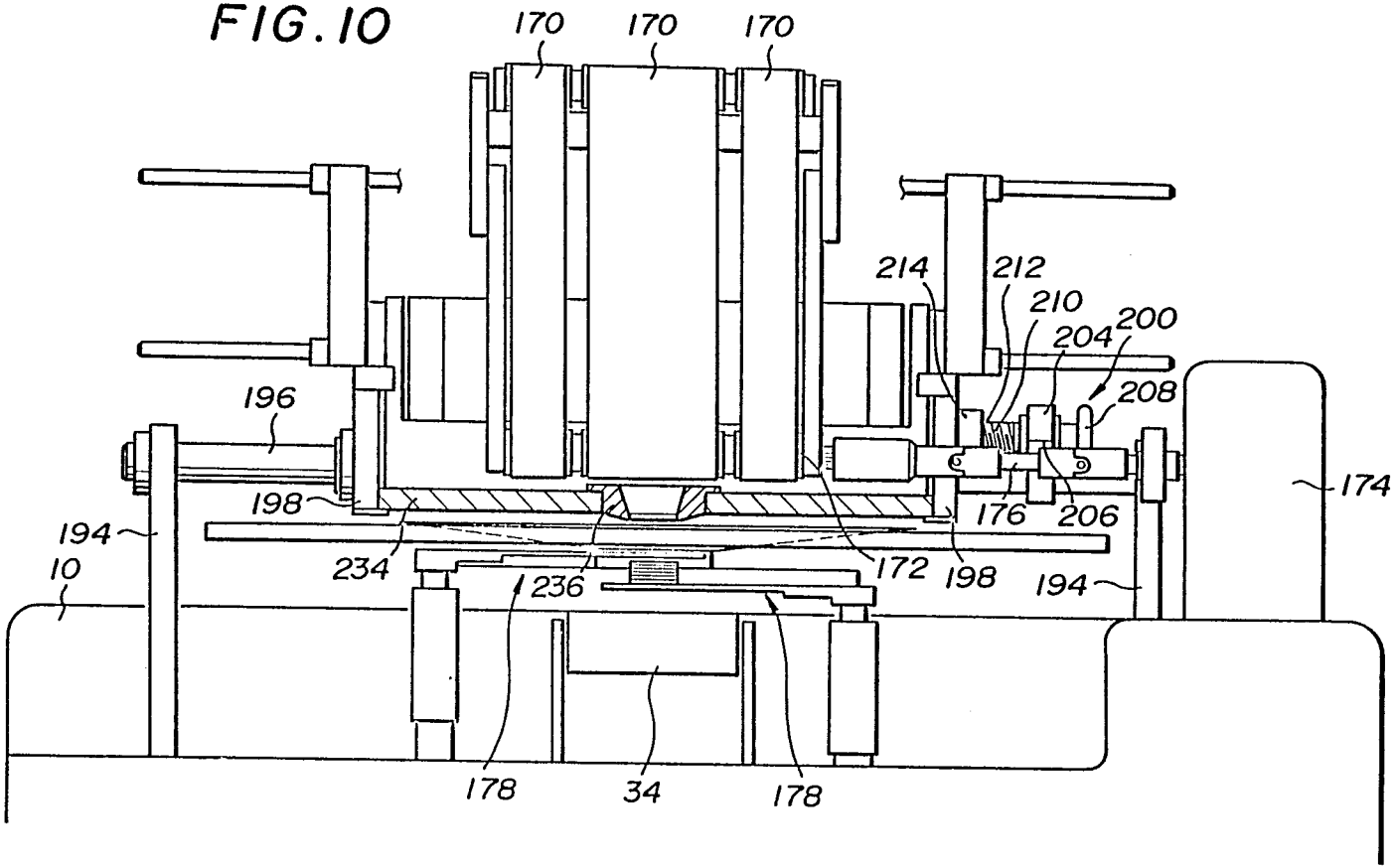
FIG. 10 is a sectional view taken along line A—A in FIG. 9.

A first positioner 200 and a second positioner 202 are provided to adjust the positions of the frame 182. As shown in FIGS. 9 and 10, the first positioner 200 includes a first beam 204 which extends across the rods 196 in the right-hand side of the figures and is fixed thereto. Formed centrally of the first beam 204 is a bore 206 through which a shaft 210 of a second handle 208 extends in a rotatable manner. The end portion of the shaft 210 opposite to the handle 208 is treaded at 212 to engage with an internally threaded ring member 214 fixed to the frame 182. Accordingly, the rotation of the handle 208 causes the frame 182 to move in the direction parallel to the belt surface 171. The drive shafts 176 are spline-connected to the pulleys 172 in order to permit the above movements of the rotary belts 170. Attached to the outer surface of one of the guide plates 198 is a first scale display 216 which cooperates with a first indicator 218 supported on the beam 204 to enable an operator to see a distance of movement of the rotary belts 170 easily.

Figure 11:
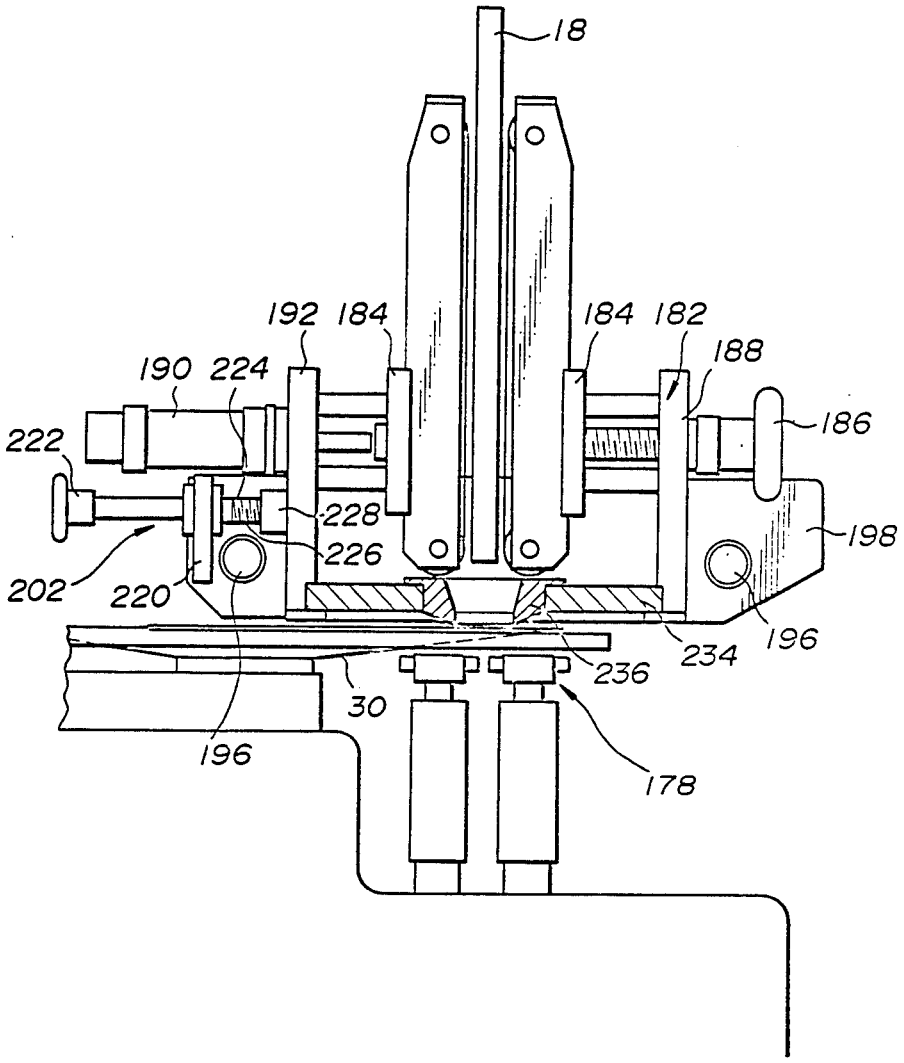
FIG. 11 is a sectional view taken along line B—B in FIG. 9.

On the other hand, the second positioner 202 has a second beam 220 extending parallel with te rod 196 between the guide plates 198 to which the rear wall 192 of the frame 182 is secured. As shown in FIG. 11, a shaft 224 of a third handle 222 extends through the second beam 220 at its central bore and terminates with a threaded portion 226 that engages with an internally threaded ring member 228 fixed to the rear wall 192 of the frame 182. Thus, by rotating the third handle 222 the frame 182 moves in the direction perpendicular to the belt surface 171 with maintaining the distance between the rotary belts. As in the first positioner 200, a second scale display 230 is attached to the rear wall 192 to cooperate with a second indicator 232 supported on the second beam 220.

Removably attached to the lower end of the frame 182 is a cover plate 234 having a center opening in which a guide member 236 is fitted. This cover plate 234 can be replaced by another one provided with another guide member having a differently dimensioned orifice, so that the feeding mechanism may deal with the loaves of various dimensions.

In operation, the rotary belts 170 first are moved away from each other by the first handle 186 and the loaf 18 is inserted between the belts. Then the handle 186 and the pneumatic cylinder 190 cooperate together for holding the loaf between the belts, as in the conventional manner. Thereafter, the rotary belts 170, together with the frame 182, are moved by the second and third handles 208 and 222 to adjust a position of the orifice of the guide member 236. A desired position of the orifice is so determined that the slices as cut by the blade 30 may fall on the center portion of the stacker 178. Since the slices are urged by the blade 30 toward the direction of movement thereof, the stacker 178 could not receive the slices accurately if the orifice would simply be aligned with the center portion of the stacker. A displacement of the slices,when compared with a free fall in which no force other than a gravity acts on the slices, depends on various factors including the kind, configuration and size of the loaf itself, temperature of the loaf which affects the stiffness thereof, and the rotational speed of the blade 30. A delicate adjustment is thus required, and the above mechanism facilitates it through the movement of the orifice together with the rotary belts 170. Usually, the orifice should be positioned such that it deviates from the center portion of the stacker 178 reawardly of the blade movement and radially outward of the blade 30.

Although the present invention has been described with reference to the preferred embodiments thereof, many modifications and alterations may be made within the spirit of the invention.

What is claimed is:

1. A loaf slicing machine comprising:

a cutting blade adapted to rotate about a center axis thereof while moving around an orbital axis to thereby cut the loaf cyclically;

feed means for intermittently advancing the loaf toward said cutting blade and extending substantially perpendicularly to said cutting blade;

a guide member disposed between said feed means and a path of said cutting blade for guiding the loaf;

a frame member supporting said feed means and said guide member, said frame member being movable together with said feed means and said guide member relative to said cutting blade in a plane substantially parallel thereto;

an abutment plate having a surface spaced from the edge of said cutting blade toward a direction of advance of the loaf for permitting the end of the loaf to substantially abut on said surface during each cutting cycle, said abutment plate having a rotational center aligned with said orbital axis and being adapted to rotate synchronously with said cutting blade; and an opening formed through said abutment plate at a position adjacent said cutting blade for permitting slices as cut to be transferred through said opening.

2. A loaf slicing machine as claimed in claim 1, wherein said feed means comprises first and second rotary belts for holding and feeding the loaf therebetween, and first and second support means for supporting said first and second rotary belts in a parallel spaced relation, said frame member having opposing walls, and each of said support means being secured to a different one of the opposing walls of said frame member.

3. A loaf slicing machine as claimed in claim 2, wherein said guide member is arranged between the end of said rotary belts and the path of said cutting blade.

4. A loaf slicing machine as claimed in claim 3, wherein said guide member has an orifice through which the loaf is advanced.

5. A loaf slicing machine as claimed in claim 4, wherein said guide member includes a stationary first jaw and a movable second jaw, each having a portion projecting into said orifice toward the center thereof, said first jaw being positioned in the forward side of a direction of movement of said cutting blade, said second jaw being positioned substantially opposite to said first jaw and urged inwardly by resilient means, and each of said first and second jaws including an inner surface having a portion for surface contact with the loaf.

6. A loaf slicing machine as in claim 5, wherein said guide member further includes a recess and wherein said second jaw is partly received in said recess.

7. A loaf slicing machine as claimed in claim 6, wherein said elastic means comprises a coil spring extending between the outer end of said second jaw and the end wall defining said recess.

8. A loaf slicing machine as claimed in claim 5, wherein said inner surface of each said jaw has another portion inclined inwardly from the end of said inner surface adjacent said feed means to said portion.

9. A loaf slicing machine as claimed in claim 8, wherein said portion of said inner surface of each said jaw extends parallel to the center axis of said orifice.

10. A loaf slicing machine as claimed in claim 1, wherein said feed means extends substantially in the vertical direction to advance the loaf downwardly, and wherein said abutment plate extends substantially in the horizontal plane.

11. A loaf slicing machine as claimed in claim 1, further including a rotary body of which rotational center comprises said orbital axis, and wherein said abutment plate is attached to said rotary body concentrically therewith.

12. A loaf slicing machine as claimed in claim 11, wherein said rotary body has a bore formed at a position adjacent the periphery thereof, and wherein said center axis of said cutting blade is rotatably retained in said bore.

13. A loaf slicing machine as claimed in claim 12, wherein said cutting blade and said rotary body are independently driven by respective motors.

14. A loaf slicing machine as claimed in claim 12, wherein said opening has a dimension at least equal to a dimension of said cutting blade.

15. A loaf slicing machine as claimed in claim 1, wherein said abutment plate comprises a disk.

16. A loaf slicing machine as claimed in claim 1, further comprising a first positioner for moving said frame member relative to said cutting blade along a first direction in said plane, and a second positioner for moving said frame member relative to said cutting blade along a second direction perpendicular to said first direction in said plane.

17. A loaf slicing machine as claimed in claim 1, wherein said frame member has a removable cover plate having an opening and wherein said guide member is secured in said opening.

* * * * *